US006688063B1

(12) United States Patent
Lee et al.

(10) Patent No.: US 6,688,063 B1
(45) Date of Patent: Feb. 10, 2004

(54) WOOD CORE EXTERIOR DOOR WITH MORTISE LOCK

(75) Inventors: Allen E. Lee, Brookings, SD (US); Bryan P. Zacher, Brookings, SD (US); Brian R. Way, Brookings, SD (US)

(73) Assignee: Larson Manufacturing Company, Brookings, SD (US)

( * ) Notice: Subject to any disclaimer, the term of this patent is extended or adjusted under 35 U.S.C. 154(b) by 0 days.

(21) Appl. No.: 09/911,604

(22) Filed: Jul. 24, 2001

Related U.S. Application Data

(60) Provisional application No. 60/220,615, filed on Jul. 25, 2000.

(51) Int. Cl.[7] ..... E06B 3/70

(52) U.S. Cl. ..... 52/455; 52/309.9; 52/457; 52/309.11; 52/501; 52/785; 52/809; 49/501; 49/503; 70/91; 70/102; 70/103; 70/104; 70/124; 70/144; 70/141; 70/450; 70/451

(58) Field of Search ..... 52/455, 501, 785, 52/809, 309.9, 457, 309.11; 49/501, 503; 70/141, 144, 91, 102–4, 124, 450, 451

(56) References Cited

U.S. PATENT DOCUMENTS 3,039,291 A * 6/1962 Dusing et al. ..... 292/337
3,513,674 A * 5/1970 Rutherford ..... 292/337
4,634,156 A * 1/1987 Shimura et al. ..... 292/216
4,696,174 A * 9/1987 Marks ..... 70/451
4,901,493 A * 2/1990 Thorn ..... 52/309.9
4,998,598 A * 3/1991 Mardian et al. ..... 181/284
5,077,948 A 1/1992 Olson et al.
5,161,346 A 11/1992 Olson et al.
5,361,552 A * 11/1994 Fulford ..... 49/501
5,391,245 A * 2/1995 Turner ..... 106/602
5,438,808 A * 8/1995 Costello ..... 52/316
5,577,363 A * 11/1996 Tate et al. ..... 52/309.11
5,634,508 A * 6/1997 Herbst ..... 160/369
5,822,926 A * 10/1998 Koike et al. ..... 49/394
5,887,398 A * 3/1999 Chen ..... 49/501
5,894,706 A * 4/1999 Herbst ..... 160/369
6,311,454 B1 * 11/2001 Kempel ..... 52/309.11
6,349,982 B2 * 2/2002 Fayngersh et al. ..... 292/165

* cited by examiner

*Primary Examiner*—Carl D. Friedman
*Assistant Examiner*—Christy M. Green
(74) *Attorney, Agent, or Firm*—Welsh & Katz, Ltd.

(57) ABSTRACT

A storm door construction includes an internal rectangular frame providing a pane opening, the frame including left and right vertical members, a head panel and a base panel. One of the left and right vertical members comprises upper and lower vertical stile pieces and a mortise box located between the upper and lower vertical stile pieces. The mortise box has an opening sized to receive a mortise lock therein. Inside and outside skin panels shaped to cover both sides of said rectangular frame and having rectangular openings substantially in registry with said rectangular pane opening are laminated onto the frame. Both vertical members can include mortise boxes for alternate left or right side mounting of the door in an external doorframe. Each mortise box can comprise upper and lower tongues, and each upper and lower vertical stile pieces can comprise a groove that is sized and shaped to engage a respective tongue of the mortise box. Each mortise box is preferably composed of plastic and the vertical stile pieces are preferably composed of particleboard.

36 Claims, 9 Drawing Sheets

WOOD CORE EXTERIOR DOOR WITH MORTISE LOCK

This application claims the benefit of provisional application U.S. Ser. No. 60/220,615 filed Jul. 25, 2000.

TECHNICAL FIELD OF THE INVENTION

The present invention relates to door structures. Particularly, the present invention relates to frame structures for storm doors and structures for supporting mortise locks within storm doors.

BACKGROUND OF THE INVENTION

To be effective, the structural design of storm doors advantageously meets certain criteria. Storm doors are desirably of small depth to be relatively lightweight and easily installed in a variety of applications. Storm doors must have a close fit within doorframes if they are to successfully control passage of air and water therethrough. Storm doors must also be sufficiently strong to withstand substantial impact loads as various kinds of objects are moved near and through the doorframes, to withstand slamming of the door by users thereof, and to withstand strong winds. Storm doors must also remain operable overwide temperature ranges. In addition, storm doors must withstand the deteriorating effects of great variations in weather over long periods of time while retaining acceptable appearance characteristics.

To meet these criteria, a number of different kinds of materials have been used for storm doors. Thus, storm doors have been constructed of assembled wooden parts, aluminum parts, or vinyl parts, and often a combination of these materials. In addition, various other polymer-based materials have been used.

Storm door structures that meet these criteria are disclosed in U.S. Pat. Nos. 5,161,346 and 5,077,948, assigned by the assignee of the present application. These patents are herein incorporated by reference. The storm doors described in these patents included the use of wooden frame members enclosed by outer shell portions formed of a composite, polymer material. The frame comprises spaced-apart vertical frame members and horizontal cross members forming a rectangular structure.

Storm doors having a security dead bolt lock allow the homeowner to leave the typical interior primary, solid door open. This is advantageous since the storm door can be made substantially transparent, or can be a screen, which passes substantially more light or air, respectively, into the house, while maintaining a securely locked entry. Exemplary storm doors can include mortise locks.

U.S. Pat. Nos. 4,696,174 and 5,634,508 disclose storm doors provided with mortise lock assemblies each including a handle, which when tumed, releases a door latch to open the door, and a dead bolt lock, key-actuated from the outside, for further security. U.S. Pat. No. 5,634,508 illustrates a recessed structure for receiving the mortise lock within the frame of the storm door. The recessed structure is foamed in place within the frame. U.S. Pat. No. 4,696,174 discloses a metal lock box for receiving a mortise lock, the box being welded to other metal parts of the door.

The present inventors have recognized the desirability of providing a door assembly that allows for the installation of a mortise lock within the wooden frame member of the door. The present inventors have recognized the desirability of providing a prefabricated vertical frame member, having a space for the mortise lock, which is economically manufactured. The present inventors have recognized the desirability of providing the prefabricated space within a frame door construction that will not weaken the wooden frame of the door to a significant extent.

SUMMARY OF THE INVENTION

The invention provides an improved frame door construction, such as for a storm door, that includes a rectangular frame or core, the frame including left and right vertical members, a head panel and a base panel. One of the left and right vertical members comprises upper and lower vertical stile pieces and a mortise box located between the upper and lower vertical stile pieces. The mortise box has an opening sized to receive a mortise lock therein.

The mortise box is preferably composed of molded plastic, such as PVC, although other materials of construction are encompassed by the invention. The upper and lower vertical stile pieces are composed of wood, preferably particleboard, although other materials of construction are encompassed by the invention.

Preferably, the mortise box and the upper vertical stile piece together comprise a first tongue-in-groove formation therebetween for securing the mortise box to the upper vertical stile piece. The mortise box and the lower vertical stile piece together comprise a second tongue-in-groove formation therebetween for securing the mortise box to the lower vertical stile piece. The tongue-in-groove connections can be strengthened by use of an adhesive applied between the mortise box and the respective vertical stile piece. The upper and lower vertical stile pieces and the mortise box advantageously have equal widths and depths.

An outside edge trim can be applied onto the door edge. A mortise lock is inserted into the opening of the mortise box with an edge plate overlying the outside edge trim and the opening of the mortise box. The outside edge trim conceals the edge plate of the mortise lock, when the door is closed to an external doorframe.

According to a further aspect of the invention, the respective other one of the vertical members also comprises upper and lower vertical stile pieces, and a second mortise box located between the upper and lower vertical stile pieces. The second mortise box has an opening sized to receive a mortise lock therein. The use of the second mortise box provides a flexibility of installation of the door for left or right side hinges. A cover plate can be provided for covering the opening into the hinge side mortise box that is not used to receive a mortise lock.

To complete the construction of the frame door, an inside skin or shell and an outside skin or shell can be laminated or otherwise attached to the frame. The inside and outside skins each provide a pane opening substantially in registry with a central pane opening of the frame. The skins are preferably composed of aluminum or vinyl.

In an exemplary embodiment of the present invention, the frame door includes a rectangular frame defining a pane opening. The frame includes right and left side upper and lower vertical stile pieces, right and left side mortise boxes, a horizontal head panel, and a horizontal base panel connected respectively between the upper vertical stile pieces and the lower vertical stile pieces to define the rectangular frame.

The mortise boxes are located between the upper and lower vertical stile pieces. The mortise boxes are sized and shaped to selectively receive a mortise lock therein. One of the left and right side mortise boxes is used to house a mortise lock, and the respective other mortise box is not used. The respective other mortise box has its opening covered by a plate.

The upper and lower vertical stile pieces include grooves extending in a widthwise direction. The mortise boxes each include an upper and a lower tongue, extending along the widthwise direction, and sized and shaped to fit tightly into a respective groove of the vertical stile pieces, to form a tongue-in-groove connection. Alternatively, one or more of the tongue-in-groove connections can be formed by a groove located on a mortise box and an engaging tongue located on an end of one of the upper or lower vertical stile pieces. The tongue-in groove connections can be strengthened by use of an adhesive between the mortise box and the respective vertical stile pieces.

By using the water-resistant material for a mortise box, water permeating through lock and a latch holes is prevented from contacting wood material. This helps to prevent wood deterioration. The width and depth of the mortise box being equal to the width and depth of the upper and lowervertical stile pieces, the mortise box forms top and bottom covers on the vertical stile pieces. The covers protect the top of the bottom vertical stile piece and the bottom of the top vertical stile piece from exposure to moisture.

The wall thickness of a molded mortise box can be more closely controlled than a machine notch in a wooden stile piece, which can be prone to deterioration or splitting. Thus, given that the thickness available for vertical support on opposite sides of the mortise lock is limited due to the desired small depth of the door, a molded mortise box ensures a more consistent and reliable frame strength in the mass production of doors.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
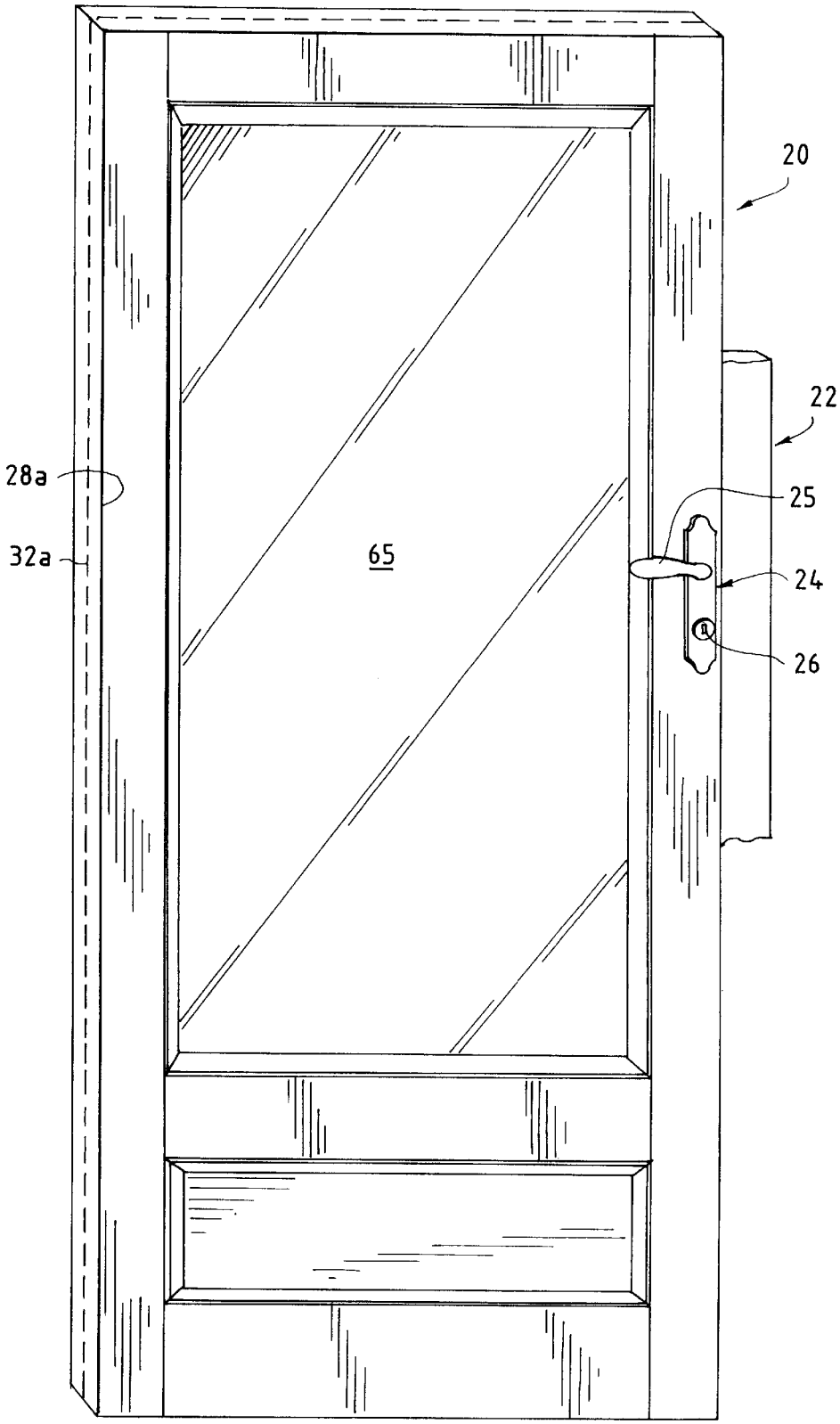
FIG. 1 is a fragmentary perspective view of a storm door mounted in an external doorframe according to the present invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a frame door 20 of the invention, such as a storm door, positioned within a doorframe 22. The door 20 is hung by hinges (not shown) on a left side of the door. A door handle and lock assembly 24 is mounted on a right side of the frame door 20. The assembly includes a door handle 25 and a lock cylinder 26.

Figure 2:
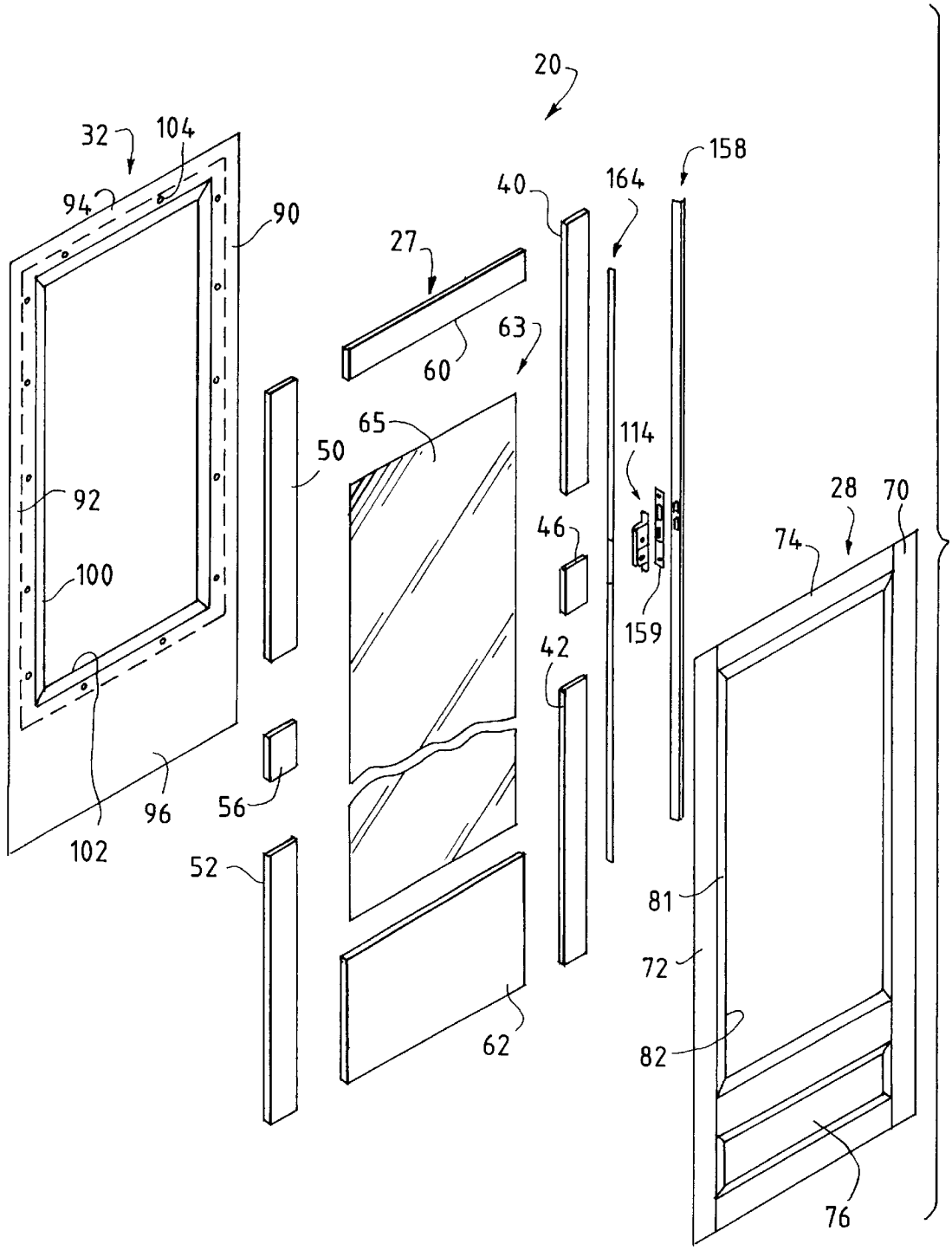
FIG. 2 is an exploded perspective view of the storm door of FIG. 1.

FIG. 2 illustrates the frame door 20 of the present invention in exploded view. The frame door 20 includes an internal frame 27, an outside skin 28 and an inside skin 32.

The internal frame 27 includes a right side, upper vertical stile piece 40, a right side lower vertical stile piece 42, and a right side mortise box 46. The right side mortise box 46 is located between the right side upper vertical stile piece 40 and the right side lower vertical stile piece 42 and connected to the right side upper vertical stile piece 40 and to the right side lower vertical stile piece 42. The frame 27 also includes a left side, upper vertical stile piece 50, and a left side upper vertical stile piece 52, and a left side mortise box 56. The left side mortise box is located between the left side upper vertical stile piece 50 and the left side lower vertical stile piece 52, and connected to the left side upper vertical stile piece 50 and to the left side lower vertical stile piece 52.

A head panel 60 extends between the right side, upper vertical stile piece 40 and the left side, upper vertical stile piece 50 and is connected thereto. A base panel 62 spans between the right side lower vertical stile piece 42 and the left side lower vertical stile piece 52 and is connected thereto.

The right side, upper vertical stile piece 40, the right side, lower vertical stile piece 42, the right side mortise box 46, the left side, upper vertical stile piece 50, the left side, lower vertical stile piece 52, the left side mortise box 56, the head panel 60, and the base panel 62 are all rigidly connected together to form the rectangular frame 27. Once assembled, the frame 27 defines a rectangular opening 63. A pane 65 comprising a glass panel, a plastic panel, a mesh screen, a solid panel, or other construction, is sized to fit, with a small fit tolerance, within the opening 63.

The outside skin 28 includes a right side vertical stile panel 70, a left side vertical stile panel 72, a head skin panel 74, and a base skin panel 76. A rectangular pane-holding frame 81 is formed integrally with, or attached to, the panels 70, 72, 74, 76, and extends inwardly of the panels 70, 72, 74, 76 to define a pane opening 82. The pane opening 82 is substantially in registry with the rectangular opening 63 of the frame 27. The pane opening 82 is somewhat smaller than the rectangular opening 63, and smaller than the pane 65, to retain the pane 65 within the opening 63.

The inside skin panel 32 includes a right side vertical stile panel 90, a left side vertical stile panel 92, a head skin panel 94, and a base skin panel 96. A rectangular pane-holding frame 100 is attached to the panels 90, 92, 94, 96 and defines a pane opening 102. The pane opening 102 is substantially in registry with the rectangular opening 63 of the frame 27.

The pane opening 102 is somewhat smaller than the rectangular opening 63, and smaller than the pane 65, to retain the pane 65 within the opening 63.

The pane-holding frame 100 is preferably fastened to the skin 32 by fasteners 104. The pane-holding frame 100 is removable to change-out the pane 65 seasonally (glass to screen, screen to glass) or for repairs. The fastener heads (not shown) would be exposed on the inside of the door for tool access to remove the frame.

The outside skin 28 and the inside skin 32 are adhesively secured onto the frame 27, to "sandwich" or laminate the frame 27 between the skins 28, 32. The skins 28, 32 can include a rectangular rim 28a, 32a (shown in FIG. 1), to finish the frame 27 around its edge, or separate edge trimming pieces can be used. The skins can be composed of vinyl or other plastic or synthetic material, or aluminum or other metal material, or any other material suitable for storm doors.

Figure 3:
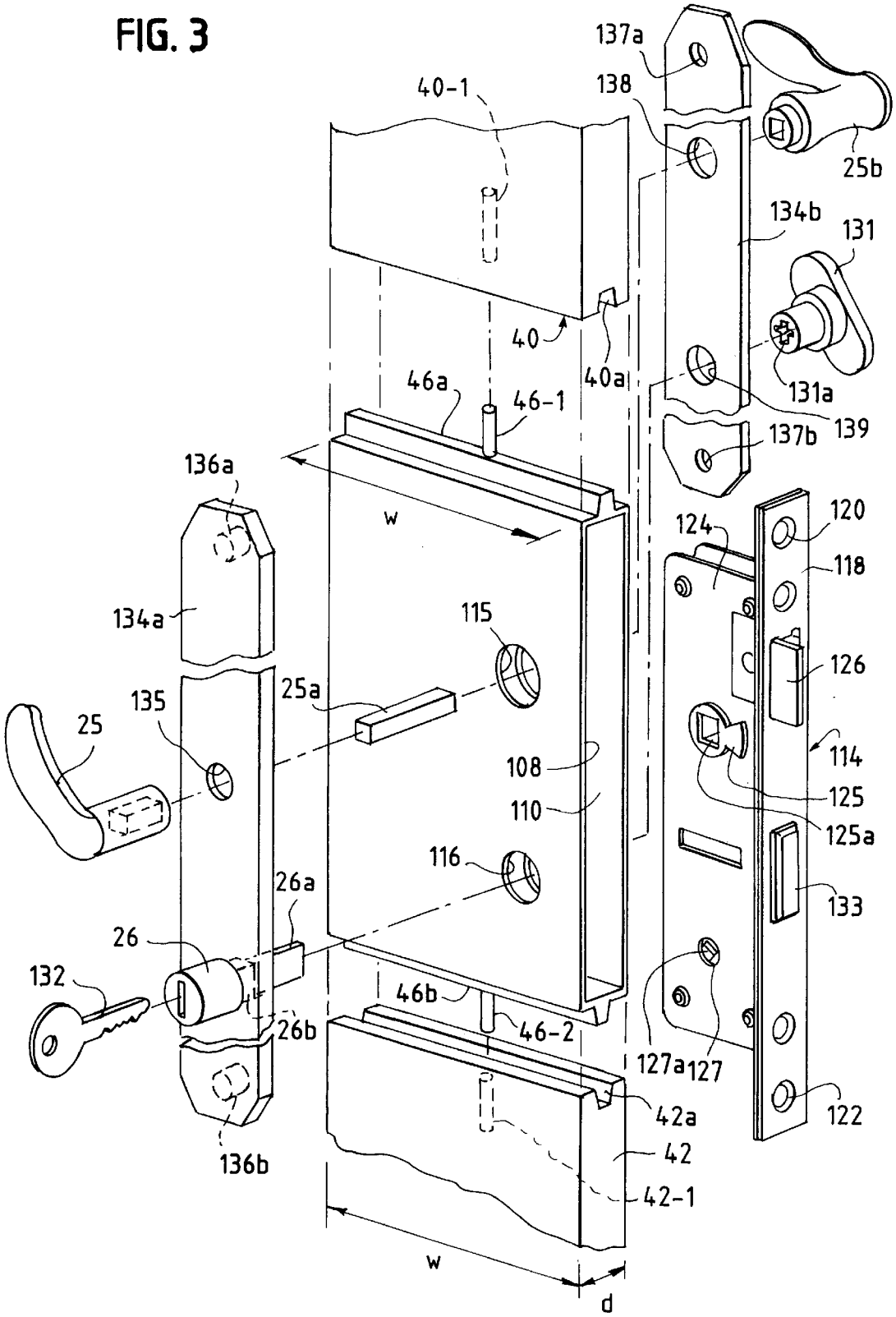
FIG. 3 is an enlarged fragmentary view of a portion of the storm door of FIG. 1.

FIG. 3 illustrates the right side mortise box 46 having an opening 108 into a space or void 110 for receiving a lock and latch assembly referred to herein as a mortise lock 114. Although the right side mortise box 46 is illustrated for use with a door having a left hand side hinge, the left side mortise box 56 could be used for a door having a right hand side hinge and its description would be substantially (mirror-image) identical. The mortise box 46 also includes a handle through-hole 115 and a lock cylinder through-hole 116.

A mortise lock 114, a doorframe trim 158, and a door trim 164 are utilized in the door installation, as described below. The mortise lock 114 includes an edge plate 118 having screw-mounting holes 120, 122 for fastening the mortise lock to the right side upper vertical stile piece 40 and the right side lower vertical stile piece 42. The mortise lock 114 includes a lock housing 124 that fits into the box 46.

When the lock housing 124 is inserted into the mortise box 46, the handle through-hole 115 lines up with a square input hole 125, and the lock through-hole 116 lines up with a lock actuator hole 127*a* of an internal lock actuator 127. The lock actuator hole 127*a* receives therein an actuator bar 26*a* of the lock cylinder 26.

The handle 25 is fixed to a square cross-sectional spindle 25*a* which extends through the square input hole 125*a* of an internal latch mechanism 125. The internal latch mechanism 125 can be forcibly turned by rotation of the spindle 25*a* by either handle 25, 25*b*, to retract the latch 126, to disengage the door from the external doorframe 22. An inside handle 25*b* is connected to an opposite end of the spindle 25*a*. A dead bolt handle 131 on the inside, and a key 132 on the outside, operate the lock cylinder 26 to turn the actuator bar 26*a* to actuate the internal lock actuator 127 to extend or retract a dead bolt 133.

An outside plate 134*a* and an inside plate 134*b* can be used to mount components to the door. The outside plate 134*a* includes a circular handle opening 135 for passing the spindle 25*a* therethrough, and a modified circular opening, with at least one flat side, for receiving a modified circular portion 26*b*, with at least one flat side, of the lock cylinder 26. The flat sides of the modified opening and the modified circular portion prevent rotation of the lock cylinder 26 with respect to the plate 134*a*.

The handles 25, 25*b* can be fixed to the spindle 25*a* using setscrews (not shown). One or both of the handles 25, 25*b* can be fixed to the plates using C-shaped spring clips (not shown). The dead bolt handle can be fixed to the plate 134*b* using a C-shaped spring clip (not shown). Plastic washers or grommets can be used between relatively rotating parts, for example between the handles 25, 25*b* and the plates 134*a*, 134*b*, respectively, for smooth, reduced-friction operation.

The plate 134*a* includes threaded bosses 136*a*, 136*b*, on an inside surface thereof, that line up with apertures 137*a*, 137*b*, respectively, through the plate 134*b*. Fasteners (not shown) can pass from an inside surface of the door to threadingly engage the bosses 136*a*, 136*b* to mount the two plates, and components carried thereby, to the door. The plate 134*b* includes a handle hole 138 for passing the spindle 25*a* therethrough, and a dead bolt hole 139 for passing the actuator bar 26*a* therethrough and into a slot 131*a* of the dead bolt handle 131.

The box 46 includes an upper locking tongue 46*a* and a lower locking tongue 46*b*. The upper locking tongue 46*a* engages a bottom groove 40*a* of the upper vertical stile piece 40 and the lower locking tongue 46*b* engages a top groove 42*a* of the lower vertical stile piece 42. The box 46 has a width w equal to a width w of the upper and lower stile pieces 40, 42, and has a depth d equal to a depth d of the upper and lower stile pieces 40, 42. Once the box 46 is fixed to the upper and lower stile pieces 40, 42 a flush construction across the width and depth is formed.

To strengthen the joints between mortise box 46 and the adjacent stiles, such as 40, 42, 50 and 52 integrally molded rods 46-1, -2 on the order of 1½ inches long can be incorporated. The rods extend axially from box 46. These rods 46-1, -2 slidably engage borings shown in phantom, 40-1, 42-1, 50-1, 52-1 in the grooves of the respective stiles and provide a stronger joint than results from just tongue and groove combinations such as 46*b*, 42*a*. The rods and borings are shown in more detail in FIG. 14.

Figure 4:
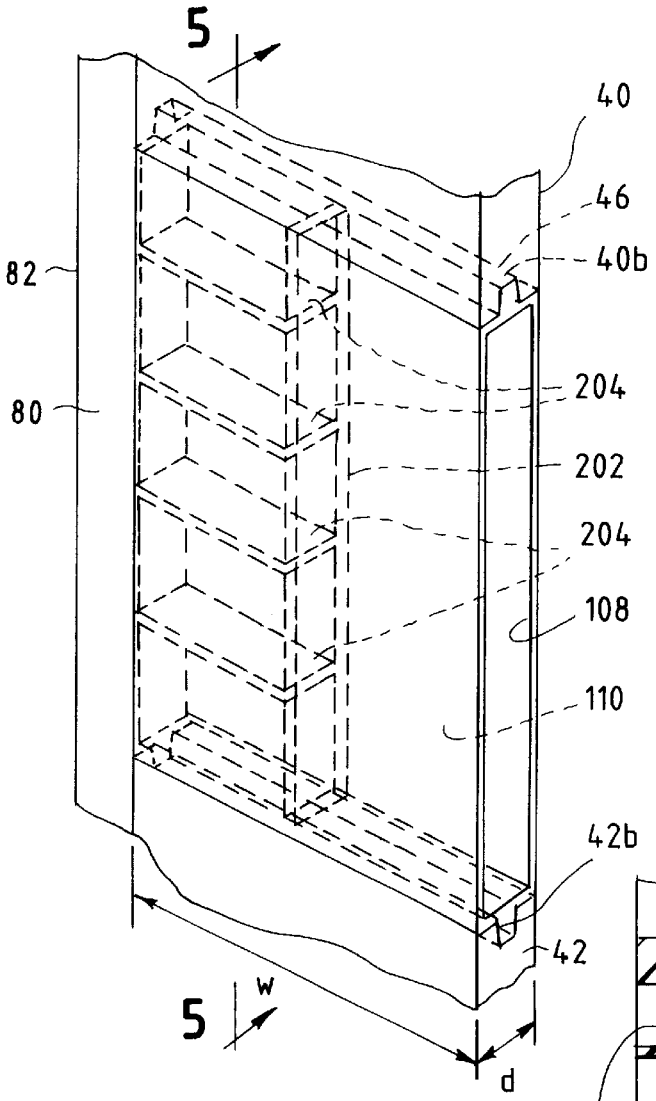
FIG. 4 is a portion of the storm door of FIG. 2 in an assembled condition.
Figure 5:
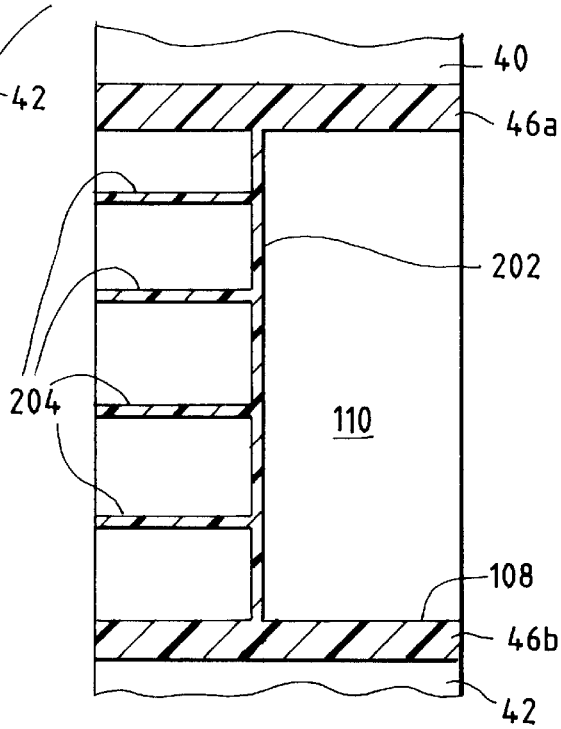
FIG. 5 is a sectional view taken generally along line 5—5 of FIG. 4.

FIGS. 4 and 5 illustrate the box 46 assembled to the stile pieces 40, 42. Layers of adhesive 40*b*, 42*b* are applied between the tongues 46*a*, 46*b* and the respective grooves 40*a*, 42*a*. Adhesive is also applied across the depth d between the stile pieces 40, 42 and the box 46. Preferably, the adhesive is coextensive with the contact area between the box 46 and the vertical stile pieces 40, 42.

The box 46 includes a vertical inside divider wall 202 and a plurality of horizontal, evenly vertically spaced divider-walls 204. The divider walls 202, 204 provide additional horizontal and vertical strength and stiffness to the box 46 in an unused space behind the space 110 occupied by the mortise lock housing 124.

Figure 6:
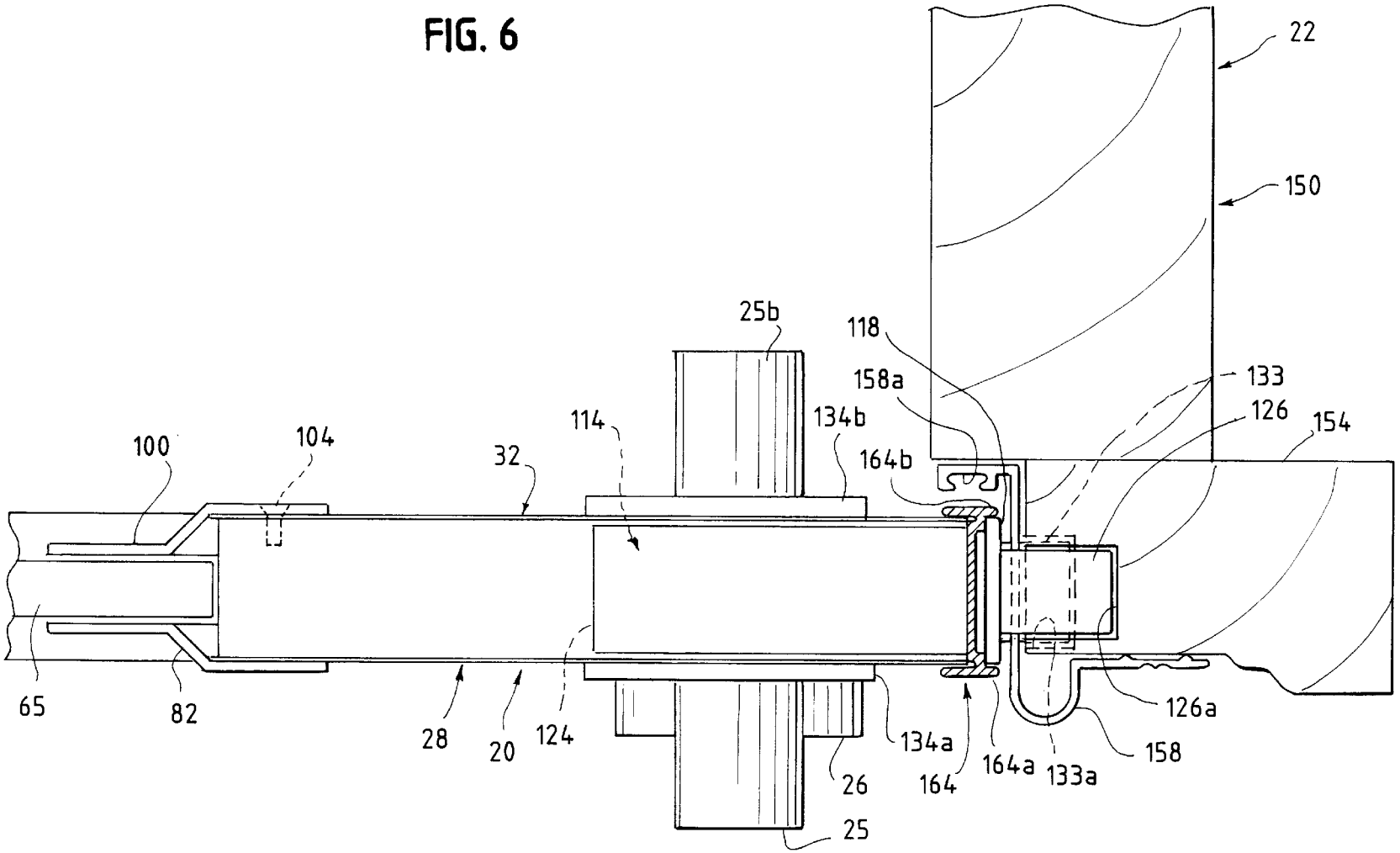
FIG. 6 is a diagrammatic sectional view taken generally along line 6—6 of FIG. 1.
Figure 7:
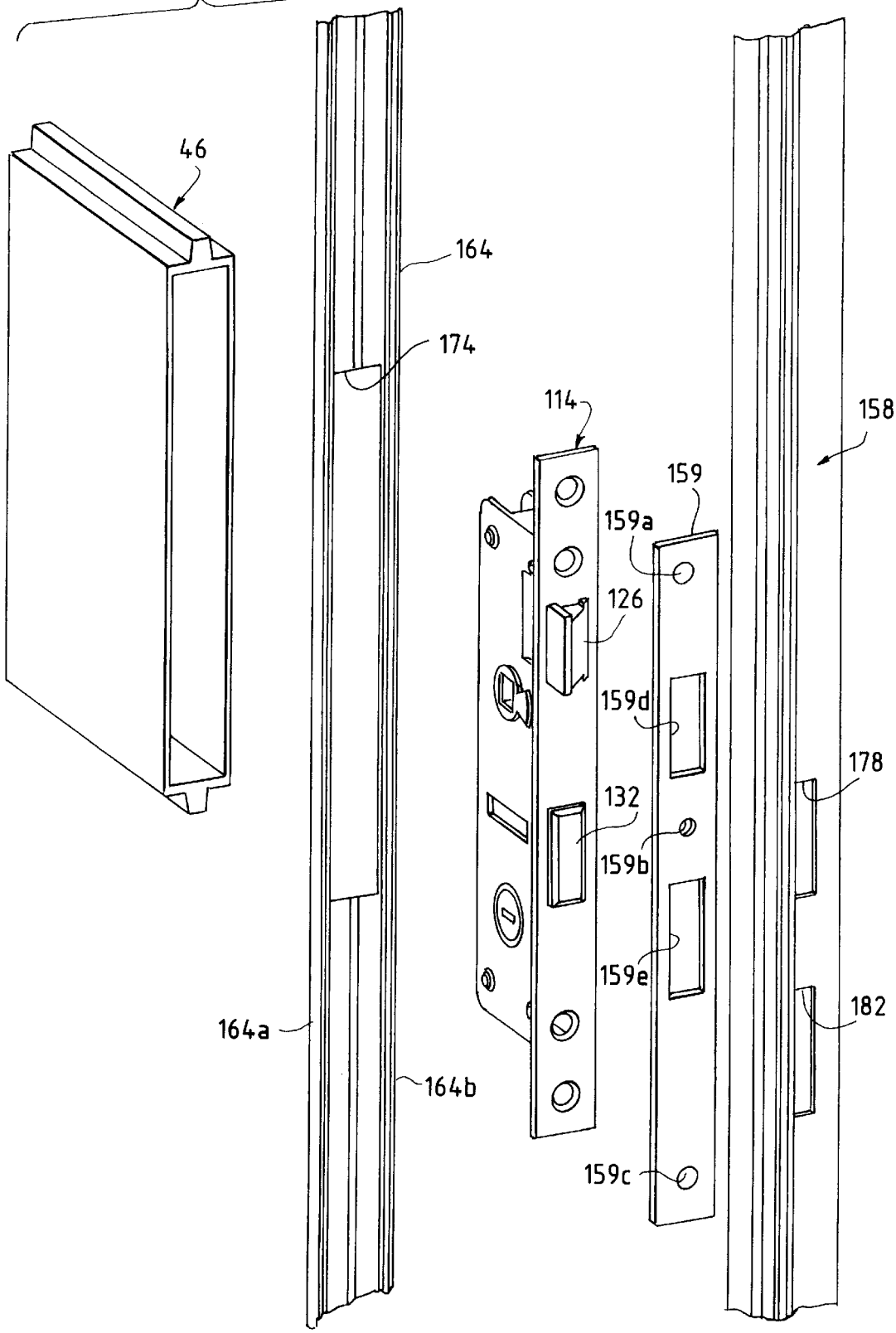
FIG. 7 is an exploded. perspective view of a portion of the storm door shown in FIG. 2, and including a doorframe trim.

FIGS. 6 and 7 further illustrate the door construction. A door trim 164 is attached to an edge of the door. The door trim includes a rectangular opening 174 (shown in FIG. 7). The housing 124 of the mortise lock 114 is inserted through the opening 174 and into the box 46 with the edge plate 118 fit over the door trim 164. The door trim 164 includes raised sidewalls 164*a*, 164*b* that conceal the edge plate 118 from view when the door is closed. A frame trim 158 substantially covers the exposed surfaces of a framing stud 150 and the brick mold trim or door jam 154 of the external doorframe 22. The frame trim includes a channel 158*a* that holds an elongated, compliant weather-stripping element (not shown).

A metallic latch plate 159 (shown in FIG. 7) can be attached over the trim 158. The latch plate 159 includes apertures 159*a*, 159*b*, 159*c* for receiving screws to secure the plate 159 to the doorframe 22. The latch plate 159 includes rectangular apertures 159*d*, 159*e* for passing the latch 126 and the dead bolt 133, respectively, through openings 178, 182 in the doorframe trim 158, and into openings 126*a*, 133*a* in the doorframe (shown in FIG. 6).

Figure 8:
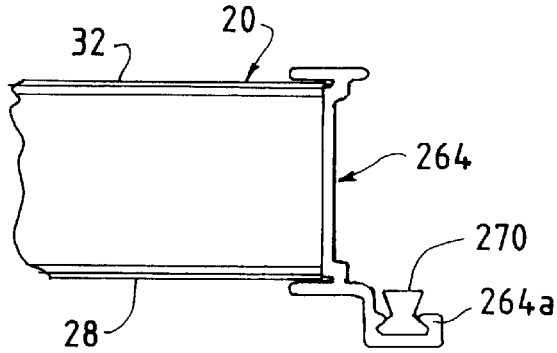
FIG. 8 is a sectional view of an alternate embodiment door trim.

FIG. 8 illustrates an alternate door trim 264 which includes a weather-stripping flange 266 having a channel 266*a* for holding an elongated, compliant weather-stripping element 270 for sealing against a doorframe.

Figure 9:
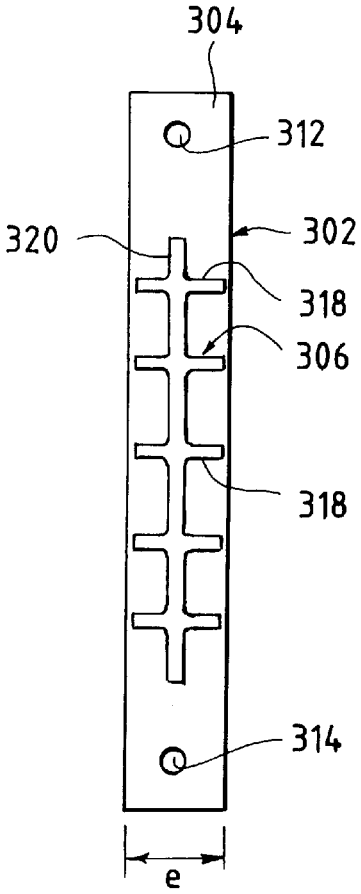
FIG. 9 is a front view of a mortise box cover plate.
Figure 10:
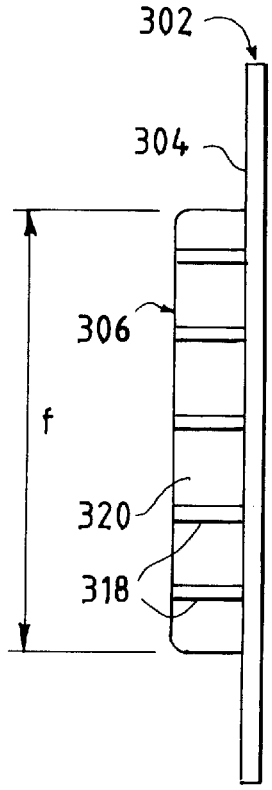
FIG. 10 is a right side view of the cover plate of FIG. 9.

FIGS. 9 and 10 illustrate a cover plate 302 used to cover the mortise box opening 108 of the mortise box 46, 56 which is on the hinge side of the door, i.e., the mortise box that is not used. The cover plate 302 includes an edge plate or base 304 and a plug portion 306. As instblled into a mortise box on the door hinge side (the empty mortise box), the plug portion fits snugly into the opening 108 of the box.

The base 304 covers the opening 108 and is attached to the upper and lower vertical stile pieces 40, 42; or 50, 52. The base 304 includes upper and lower apertures 312, 314 for receiving screws for securing the plate to the respective upper and lower vertical stile pieces 40, 42; or 50, 52.

The plug portion 306 includes spaced-apart horizontal stiffeners 318 and a central vertical stiffener 320. The horizontal stiffeners have a depth e equal to an inside depth of the box 46 (along the direction d) to stiffen and strengthen the box 46, 56 against horizontal compression forces. The vertical stiffener 320 can give added vertical strength and stiffness to the cover plate 302 and to the box 46, 56.

Figure 11:
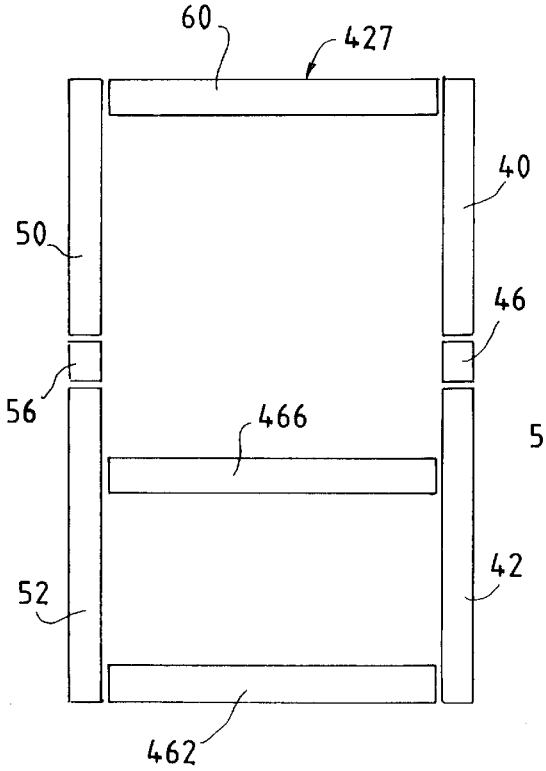
FIG. 11 is an exploded view of a portion of an alternate embodiment storm door.

FIG. 11 illustrates, in exploded view, a further embodiment internal frame 427 that differs from the internal frame 27 in that a base panel or bottom sill 462 is of a reduced-height. The frame 427 also includes a mullion 466 connected between opposite lower vertical stile pieces 42, 52. The internal frame 427 is otherwise assembled and finished as described for the internal frame 27.

Figure 12:
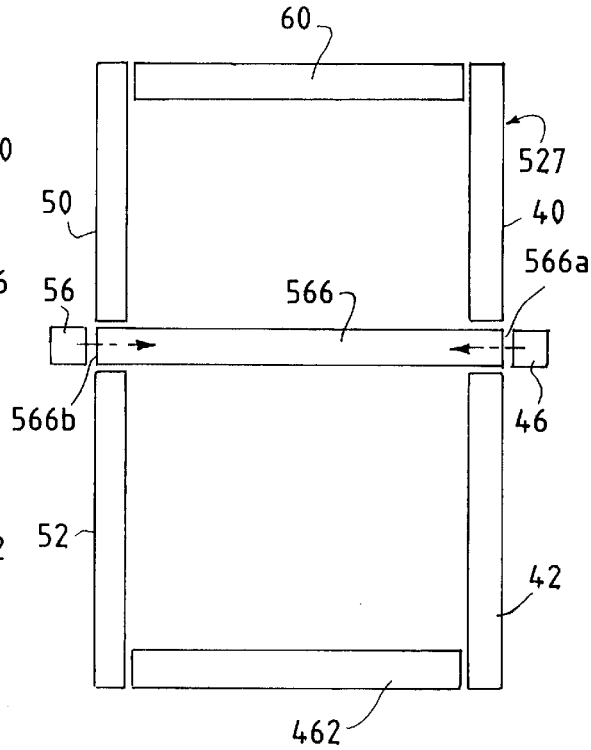
FIG. 12 is an exploded view of a portion of a further alternate embodiment storm door.

FIG. 12 illustrates, in exploded view, a still further embodiment internal frame 527 that differs from the internal frame 427 of FIG. 11, in that a mullion 566 is located vertically aligned with the mortise boxes 46, 56. The mullion 566 includes open rectangular ends 566*a*, 566*b* that are relatively sized to accept the mortise boxes 46, 56 in a close-fitting manner therein. The internal frame 527 is otherwise assembled and finished as described for the internal frame 27.

Figure 13:
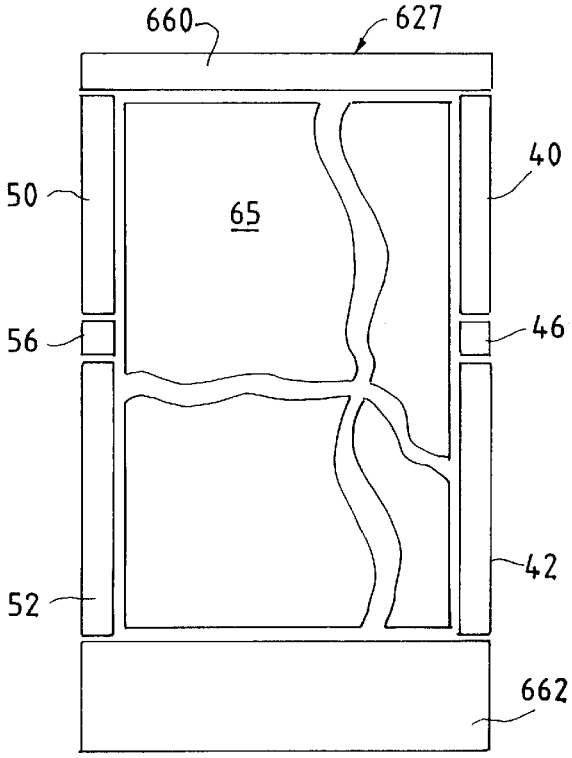
FIG. 13 is an exploded view of a portion of another alternate embodiment storm door.

FIG. 13 illustrates, in exploded view, another embodiment internal frame 627 that differs from the internal frame 27 of FIG. 1 in that the header panel 660 and base panel 662 have lengths that span the width of the frame 627. The base panel 662 underlies the lower stile pieces 42, 52 and the header panel 660 overlies the upper stile pieces 40, 50. The internal frame 627 is otherwise assembled and finished as described for the internal frame 27.

The mortise boxes 46, 56 are preferably composed of molded plastic, such as PVC. Alternatively, the mortise boxes can be composed of molded wood/resin fibers, or other materials.

The vertical stile pieces 42, 42, 50, 52, the mullions 466, 566, and the header and base pieces 60, 62, 462, 660, 662 can be composed of wood, particleboard, medium density fiberboard (MDF), honeycombed material, foam filled styrene, composite wood, engineered wood-type materials, foam filled materials, or other material.

Figure 14:
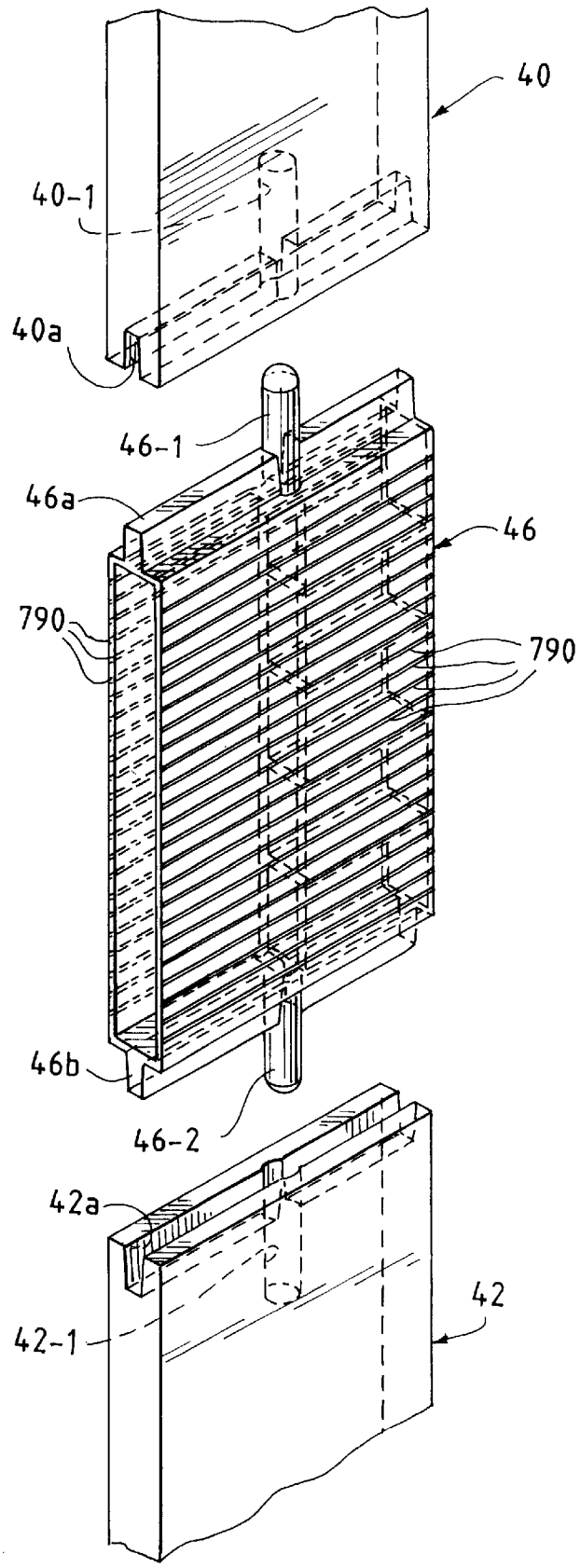
FIG. 14 is an exploded perspective view of a portion of the storm door shown in FIG. 2.

FIG. 14 illustrates the mortise box 46 (the box 56 being substantially identical) to be connected between the upper and lower stile pieces 40, 42. The mortise box 46 includes the upper and lower rods or dowels 46-1, 46-2 formed integrally with upper and lower tongues 46*a*, 46*b*, respectively. The upper stile piece 40 includes the groove 40*a* open into the boring 40-1. The lower stile piece 42 includes the groove 42*a* open into the boring 42-1. When assembled, the tongues 46*a*, 46*b* and rods 46-1, 46-2 are coated with adhesive and pressed tightly into the respective groove 40*a*, 42*a* and boring 40-1, 42-1, respectively.

The box 46 also includes striations or grooves 790 on opposite faces thereof. Each groove 790 has a groove cross section that is semicircular with a diameter of about 0.02 inches. The purpose of the grooves 790 is to receive adhesive and provide an adhesive removal channel when the skin is adhesively secured flush to the box 46 to prevent an uneven surface of the skin.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A frame door, comprising:

a rectangular frame, said frame including left and right vertical members, a head panel and a base panel; wherein one of said left and right vertical members comprises upper and lower vertical stile pieces and a separate mortise box located between said upper and lower vertical stile pieces, said mortise box having an opening sized to receive a mortise lock therein; and where the mortise box carries at least one of an extension or a depression for engaging with a mating feature of at least one of the stile pieces to thereby strengthen the joint between the mortise box and the respective stile piece.

2. The frame door according to claim 1, wherein said respective other of said vertical members comprises upper and lower vertical stile pieces, and a second mortise box located between said upper and lower vertical stile pieces, said second mortise box having an opening sized to receive a mortise lock therein.

3. The frame door according to claim 2, comprising a cover plate for covering said opening into said second mortise box.

4. The frame door according to claim 1, comprising an inside skin and an outside skin each providing a pane opening substantially in registry with an inside opening of said frame, said inside and outside skins are applied onto said frame to cover said upper and lower vertical stile pieces and said mortise box.

5. The frame door according to claim 1, comprising an inside skin and outside skin each providing a pane opening substantially in registry with an inside opening of said frame, said inside and outside skin is applied onto said frame to cover said vertical members.

6. The frame door according to claim 1, wherein said mortise box is composed of plastic.

7. The frame door according to claim 1, wherein said upper and lower vertical stile pieces are composed of wood.

8. A frame door, comprising:

a rectangular frame, said frame including left and right vertical members, a head panel and a base panel; wherein one of said left and right vertical members comprises upper and lower vertical stile pieces and a separate mortise box located between said upper and lower vertical stile pieces, said mortise box having an opening sized to receive a mortise lock therein; and wherein said mortise box and said upper vertical stile piece together comprise a first tongue-in-groove formation for securing of said mortise box to said upper vertical stile piece; and said mortise box and said lower vertical stile piece together comprise a second tongue-in-groove formation for securing of said mortise box to said lower vertical stile piece together comprise a second tongue-in-groove formation for securing of said mortise box to said lower vertical stile piece.

9. The frame door according to claim 1 wherein said upper and lower vertical stile pieces and said mortise box have equal widths and depths.

10. The frame door according to claim 1, wherein said frame includes a mullion arranged between said left and right vertical members, located spaced from and between said head panel and said base panel.

11. The frame door according to claim 10, wherein said mullion extends between said upper and lower vertical stile pieces, and said mullion has an open end sized to receive said mortise box therein.

12. The frame door according to claim 11, wherein said respective other of said vertical members comprises upper and lower vertical stile pieces, and a second mortise box located between said upper and lower vertical stile pieces, said second mortise box having an opening sized to receive a mortise lock therein wherein said mullion extends between said upper and lower vertical stile pieces of said respective other vertical member, and said mullion has a respective opposite open end sized to receive said second mortise box therein.

13. The frame door according to claim 12, wherein said mortise boxes are composed of a material selected from the group consisting of cured resin and wood resin fibers; and said vertical stile pieces are composed of a material selected from the group consisting of particle board, medium density fiberboard, honeycombed material, foam-filled styrene, composite wood, engineered wood, foam-filled composite material.

14. The frame door according to claim 12, comprising an inside skin and an outside skin each providing a pane opening substantially in registry with an inside opening of said frame, said inside and outside skins are applied onto said frame to cover said upper and lower vertical stile pieces and said mortise box.

15. The frame door according to claim 10 comprising an inside skin and an outside skin each providing a pane opening substantially in registry with an inside opening of said frame, said inside and outside skins are applied onto said frame to cover said upper and lower vertical stile pieces and said mortise box.

16. The frame door according to claim 1, wherein said mortise box is composed of plastic; and said vertical stile pieces are composed of a material selected from the group consisting of particle board, medium density fiberboard, honeycombed material, foam-filled styrene, composite wood, engineered wood, foam-filled composite material.

17. A frame door, comprising:

an internal frame including a right side vertical member having an upper vertical stile piece, a mortise box, and a lower vertical stile piece;

a left side vertical member having an upper vertical stile piece, a mortise box and a lower vertical stile piece;

a head panel;

a base panel;

the mortise boxes connecting the upper and lower vertical stile pieces of the left member and the right side member respectively, the mortise boxes having openings facing outwardly, which are sized to selectively receive a mortise lock therein, the upper vertical stile pieces connected together by the head panel;

the lower vertical stile pieces connected together by the base panel;

the left side of vertical member, the right side vertical member, the head panel, and the base panel, together define a rectangular frame having a rectangular pane opening;

inside and outside skin panels shaped to cover both sides of the rectangular frame; and wherein said mortise boxes each comprise upper and lower tongues, and said upper and lower vertical stile pieces each comprise a groove sized and shaped to engage a respective tongue of said mortise boxes.

18. A frame door, comprising:

an internal frame including a right side vertical member having an upper vertical stile piece, a mortise box, and a lower vertical stile piece;

a left side vertical member having an upper vertical stile piece, a mortise box and a lower vertical stile piece;

a head panel;

a base panel;

said mortise boxes connecting said upper and lower vertical stile pieces of said left side member and said right side member respectively, said mortise boxes having openings facing outwardly, which are sized to selectively receive a mortise lock therein, said upper vertical stile pieces connected together by said head panel;

said lower vertical stile pieces connected together by said base panel; said left side of vertical member, said right side vertical member, said head panel and said base panel, together define a rectangular frame havinp a rectangular pane opening; and inside and outside skin panels shaped to cover both sides of said rectangular frame wherein said mortise boxes are composed of plastic and said vertical stile pieces are composed of particle board.

19. A frame door, comprising:

an internal frame including a right side vertical member having an upper vertical stile piece, a mortise box, and a lower vertical stile piece;

a left side vertical member having an upper vertical stile piece, a mortise box and a lower vertical stile piece;

a head panel;

a base panel;

said mortise boxes connecting said upper and lower vertical stile pieces of said left side member and said right side member respectively, said mortise boxes having openings facing outwardly, which are sized to selectively receive a mortise lock therein, said upper vertical stile pieces connected together by said head panel;

said lower vertical stile pieces connected together by said base panel;

said left side of vertical member, said right side vertical member, said head panel, and said base panel, together define a rectangular frame having a rectangular pane opening; and inside and outside skin panels shaped to cover both sides of said rectangular frame;

wherein said mortise boxes are composed of plastic; and said vertical stile pieces are composed of a material selected from the group including particle board, medium density fiberboard, honeycombed material, foam-filled styrene, composite wood, engineered wood, foam-filled composite material.

20. A frame door, comprising:

an internal frame including a right side vertical member having an upper vertical stile piece, a mortise box, and a lower vertical stile piece;

a left side vertical member having an upper vertical stile piece, a mortise box and a lower vertical stile piece;

a head panel;

a base panel;

the mortise boxes connecting the upper and lower vertical stile pieces of the left side member and the right side member respectively, the mortise boxes having openings facing outwardly, which are sized to selectively receive a mortise lock therein, the upper vertical stile pieces connected together by the head panel;

the lower vertical stile pieces connected together by the base panel;

the left side of vertical member, said right side vertical member, the head panel, and the base panel, together define a rectangular frame having a rectangular pane opening;

inside and outside skin pahels shaped to cover both sides of the rectangular frame; and wherein said mortise boxes each comprise upper and lower tongues, and upper and lower dowels, and said upper and lower vertical stile pieces each comprise a groove and a bore, sized and shaped to engage a respective tongue and a respective dowel of said mortise boxes.

21. A frame door, comprising:

a rectangular frame, the frame including left and right vertical members, a head panel and a base panel; wherein one of the left and right vertical members comprises upper and lower vertical stile pieces and a mortise box located between the upper and lower vertical stile pieces, the mortise box having an opening sized to receive a mortise lock therein; and wherein said mortise boxes each comprise upper and lower tongues, and upper and lower dowels, and said upper and lower vertical stile pieces each comprise a groove and a bore, sized and shaped to engage a respective tongue and a respective dowel of said mortise boxes.

22. A frame door, comprising:

a rectangular frame, the frame including left and right elongated members, a head panel and a base panel; wherein one of the left and right members comprises separate upper and lower stile pieces and a mortise box located between and coupled to the upper and lower stile pieces, the mortise box having an opening sized to receive a mortise lock therein, wherein the upper and lower stile pieces and the mortise box form a unitary structure; and wherein the mortise box and the upper stile piece together comprise a first tongue-in-groove formation for securing the mortise box to the upper stile piece; and the mortise box and the lower stile piece together comprise a second tongue-in-groove formation for securing of the mortise box to the lower stile piece.

23. A frame door according to claim 22, wherein the respective other of the elongated members comprises separate upper and lower stile pieces, and a second mortise box located between the upper and lower stile pieces, the second mortise box having an opening sized to receive a mortise lock therein.

24. A frame door according to claim 23, comprising a cover plate for covering the opening into an unused one of the mortise boxes.

25. A frame door according to claim 22, comprising an inside skin and an outside skin each providing a pane opening substantially in registry with an inside opening of the frame, the inside and outside skins are applied onto the frame to cover the upper and lower stile pieces and the mortise box.

26. A frame door according to claim 22, wherein the mortise box is separate from and coupled to the stile pieces.

27. A frame door according to claim 26, wherein the frame includes a mullion arranged between the left and right elongated members, located spaced from and between the head panel and the base panel.

28. A frame door according to claim 22, wherein the mortise boxes are formed of a material selected from a group which includes cured resin and wood resin fibers; and the stile pieces are formed of a material selected from a group including particle board, medium density fiberboard, honeycombed material, foam-filled styrene, composite wood, engineered wood, foam-filled composite material.

29. A frame door, comprising:

a rectangular frame, the frame including left and right elongated, side members, a head panel and a base panel; wherein one of the left or right side members comprises first and second separate stile pieces and a mortise box located between the stile pieces, the mortise box having an opening sized to receive a mortise lock therein; and the mortise box carrying a joint strengthening feature which engages a mating feature when the box is located between the stile pieces, the strengthening feature either extends from a selected surface of the box, or is recessed in a selected surface of the box.

30. The frame door according to claim 29, wherein the respective other elongated side member comprises third and fourth separate stile pieces, and a second mortise box located between the third and fourth stile pieces, the second mortise box having an opening sized to receive a mortise lock therein.

31. The frame door according to claim 30, comprising a cover plate for covering an opening into an unused mortise box.

32. A door as in claim 29 wherein the mortise box is separate, from and coupled to the stile pieces.

33. A door as in claim 32 wherein the mortise box is attached to one of the stile pieces or a mullion which extends between the left and right elongated members.

34. A door as in claim 29 where the joint strengthening feature comprises at least one of a tongue, a groove, a pin or a boring.

35. A door as in claim 34 where the mating feature comprises at least one of a groove, a tongue, a boring or a pin.

36. A door as in claim 29 where the joint strengthening feature and the mating feature slidably engage one another.

* * * * *